US006401845B1

(12) United States Patent
Fielder

(10) Patent No.: US 6,401,845 B1
(45) Date of Patent: Jun. 11, 2002

(54) CUTTING ELEMENT WITH STRESS REDUCTION

(75) Inventor: Coy M. Fielder, Cypress, TX (US)

(73) Assignee: Diamond Products International, Inc., Houston, TX (US)

( * ) Notice: Subject to any disclaimer, the term of this patent is extended or adjusted under 35 U.S.C. 154(b) by 0 days.

(21) Appl. No.: 09/583,488

(22) Filed: May 31, 2000

Related U.S. Application Data

(63) Continuation-in-part of application No. 09/391,033, filed on Sep. 7, 1999, now Pat. No. 6,315,067, which is a continuation-in-part of application No. 09/129,179, filed on Apr. 16, 1998, now Pat. No. 6,026,919.

(51) Int. Cl.[7] ..... E21B 10/12
(52) U.S. Cl. ..... 175/432; 175/428
(58) Field of Search ..... 175/428, 430, 175/431, 432

(56) References Cited

U.S. PATENT DOCUMENTS 5,486,137 A * 1/1996 Flood et al. ..... 451/540
5,971,087 A * 10/1999 Chaves ..... 175/432
6,145,607 A * 11/2000 Griffin et al. ..... 175/426
6,202,771 B1 * 3/2001 Scott et al. ..... 175/432

* cited by examiner

*Primary Examiner*—David Bagnell
*Assistant Examiner*—Zakiya Walker
(74) *Attorney, Agent, or Firm*—Sankey & Luck, L.L.P.

(57) ABSTRACT

The present invention is directed to an improved cutting element for use with rotating downhole tools. More specifically, the present invention is directed to a compact cutter which includes unique configurations for the interface regions between the substrate the abrasive element to promote superior impact resistance and adhesion.

24 Claims, 6 Drawing Sheets

CUTTING ELEMENT WITH STRESS REDUCTION

CROSS-REFERENCE TO RELATED APPLICATIONS

This application is a continuation-in-part of U.S. application Ser. No. 09/391,033 as filed on Sep. 7, 1999, now U.S. Pat. No. 6,315,067 which in turn was a continuation-in-part from application Ser. No. 09/129,179 filed Apr. 16, 1998 which issued as U.S. Pat. No. 6,026,919 on Feb. 22, 2000.

BACKGROUND OF THE INVENTION

1. Field of the Invention

The present invention generally relates to abrasive cutters to be applied to rotating downhole tools useful in creating subterranean boreholes. More specifically, the present invention is directed to a compact cutter including an interface region between the substrate and the abrasive element to promote superior impact resistance and adhesion.

2. Description of the Prior Art

Polycrystalline diamond compacts (PDC) are commonly used in oil field drilling and machine tools. A PDC is a synthetic form of diamond that is made by pressing diamond powder and cobalt onto a cemented tungsten carbide substrate. In the press, the cobalt becomes liquid and acts as a catalyst for diamond grain growth. The result is a highly abrasive, e.g. roughly 90% as abrasive as natural diamond, and environmentally resistant component which is very adaptable to drilling systems for resistant rock formations.

Although PDC is resistant to abrasion and erosion, a PDC compact cutter demonstrates several disadvantages. The main components of the PDC system, diamond and tungsten carbide, are brittle materials subject to impact fracturing. Moreover, because tungsten carbide and diamond have different coefficients of thermal expansion, there are residual stresses in a PDC system because the tungsten carbide demonstrates greater contraction during the cooling phase than that of the synthetic diamond.

As a result of the aforereferenced disadvantages, attempts have been made in the art to limit the affects by modifying the geometry at the interface between the diamond and the tungsten carbide. Such modifications have usually taken the place of an irregular, non planar interface geometry. The most beneficial resultant of the non-planar interface, defined as any design where the interface between the diamond and tungsten carbide is not a circular plane, is the redistribution of residual stresses. Redistributing residual stresses allow the PDC manufacturer to increase the diamond thickness, thereby providing increased wear resistance. An irregular interface is advantageous since brittle materials are more resistant to compressive loads than tensile loads. The existence of a flat interface causes tensile stress plane between the diamond and tungsten carbide. This plane generally defines a main failure locus for delamination of the diamond layer.

One cutter which first utilized a non-planar interface geometry was the "Claw" cutter, so named as a result of the wear pattern of a worn cutter which looked like the remnants of claw marks. The interface of the "Claw" cutter, when viewed in cross section, consists of a plurality of parallel ridges and grooves disposed across the diameter. The "Claw" cutter provided advantages in the areas of wear resistance, but demonstrated a number of disadvantages which included the need to orient the cutter in order to position the parallel diamond inserts normal to the cutting surface. This required orientation of the cutter vis-a-vis the drill bit body complicates the manufacture process.

The so called "ring claw" cutter adopted a similar design to that of the Claw cutter except that the Ring Claw included a enhanced thickness ring of synthetic diamond which bounded a series of parallel inserts which also includes diamond of an enhanced thickness. The Ring Claw cutter demonstrated improved wear resistance over the Claw cutter, but when the outer diamond ring became worn, demonstrated similar disadvantages as to the need for precise orientation vis-a-vis the work surface.

Another prior art cutter is known as the "target cutter", and is characterized by an alternating grooves and ridges formed on the cutting face in the form of a target. The target cutter, while addressing the issue of orientation presented by the "Ring Claw cutter," demonstrated vulnerability to hoop stresses. Hoop stresses are created on the bounding ridges of tungsten carbide positioned interior to grooves filled with synthetic diamond. Hoop stresses are caused by uninterrupted concentric grooves and ridges in the PDC. During cooling of the PDC after pressing, the tungsten carbide ridges will contract and compress on the synthetic diamond rings disposed in the internal grooves. Such contraction simultaneously pulls the tungsten carbide substrate away from diamond disposed in external rings. These differential stresses create a tensile load between all of the internal tungsten carbide ridges and synthetic diamond disposed in all external grooves. such stresses can be severe enough to completely delaminate the synthetic diamond layer. A more common failure is the creation of stress zone in the interface, where fractures due to impact can originate.

Moreover, both the "Claw" and the "target cutter" suffered from brazing problems associated with attempts to increase the thickness of the diamond layer. Such additional thicknesses also resulted in reduced impact resistance. In all such prior art cutters, the highest level of stress is found at the edge where cutting forces and impact forces are the highest. Thus, even thought the "Claw" and "target cutter" incorporated a substrate to abrasive interface which included one or more grooves, the uninterrupted thickness and width of the abrasive in these grooves still gave rise to stresses which would often result in stress fracturing and ultimately the complete failure of the cutting element.

SUMMARY OF THE INVENTION

The present invention addresses the above and other disadvantages of prior cutter designs by providing a tool insert comprising a generally disc-shaped abrasive compact having a major front surface and a beveled or arcuate back surface, where at least a part of the periphery of the insert defines a cutting edge. The insert itself is comprised of a hard metal substrate backed to an abrasive compact material, e.g. synthetic diamond, where the substrate defines a partially beveled or tapered surface.

In a first embodiment, the substrate defines a major planar surface which incorporates a circumferential slot or groove at its outermost radial border such that the thickness of the abrasive layer about the slot or groove is greater than at the planar region. The circumferential groove is defined by an upper and lower inner boundary and the radial border or periphery of the element. In this embodiment, the trace between the upper and lower portions of the inner boundary is characterized by an arcuate or beveled edge.

In a second embodiment, the substrate defines a major planar surface which incorporates a circumferential slot or groove at its outermost radial border such that the thickness of the abrasive layer about the slot or groove is greater than at the planar region. The circumferential groove is again defined by an upper and lower inner boundary and the radial border or periphery of the element. In this embodiment, however, the trace between the upper and lower portions of the inner boundary includes one or more steps which may themselves include an arcuate or beveled subtrace.

The present invention offers a number of advantages over the prior art. One such advantage is the ability to increase the thickness of the cutting material where it is most needed to resist stresses experienced in the cutting processes.

The present invention also serves to minimize failures occasioned as a result of differential expansion coefficients between the abrasive material and the underlying substrate during the cooling phase. The cutter also presents a uniform thickness of abrasive material around the circumference of the cutter with relative radial symmetry.

Further, the cutter of the present invention facilitates drill bit manufacture since the cuter can be oriented at any angle on the drill bit body during assembly.

Yet other advantages of the invention will become obvious to those skilled in the art in light of the drawings and the description of the preferred embodiment.

DETAILED DESCRIPTION OF THE PREFERRED EMBODIMENTS

The present invention achieves a means of mitigating the level of stresses in the geometrical features defining the interface between the substrate and the superabrasive material of a cutting element.

Figure 1:
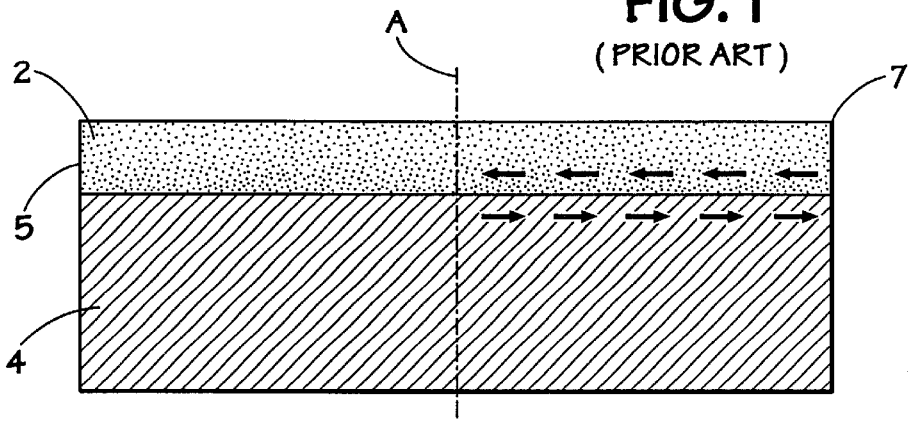
FIG. 1 (PRIOR ART)
FIG. 1 is a side cross-section of a typical cutting element illustrating sheer stresses.

By reference to FIG. 1, sheer stresses between the superabrasive compound table and the substrate are caused by the differential expansion rates between the materials most often comprising these features, polycrystalline diamond 2 and carbide 4, respectfully. The stress caused by this differential expansion varies as the distance increases along the interface 5. For example, in the original PDC cutter designs sheer stresses were very low near the center axis "A" but increased toward the periphery 7. The amount of this stress was related to the distance from the cutter center to its edge.

Figure 2:
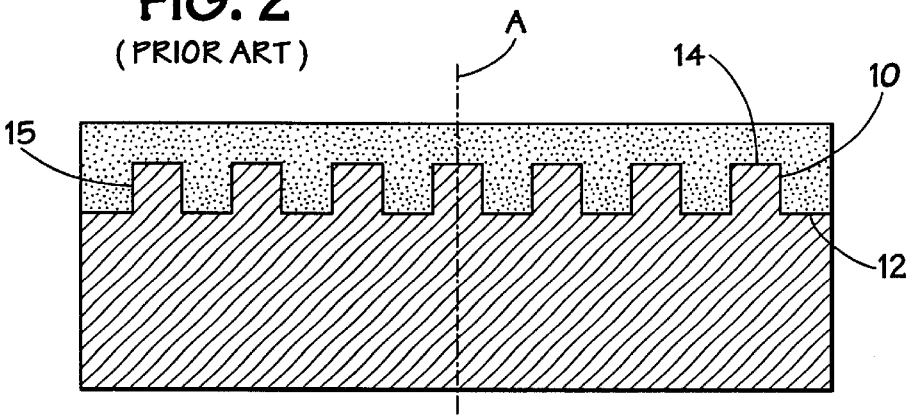
FIG. 2 (PRIOR ART)
FIG. 2 is a side cross-section of a "ring claw" cutter illustrating compressive stresses.

In a "step" design utilizing grooves and channels, the stress is lowest at the bottom 12 of the groove or step 10 and greatest at the top 14, with stresses increasing as a factor of the step height. (See FIG. 2) "Stepped" designs also suffer from problems of compression interface stresses which occur along the inside wall 15 of the step.

Figure 3:
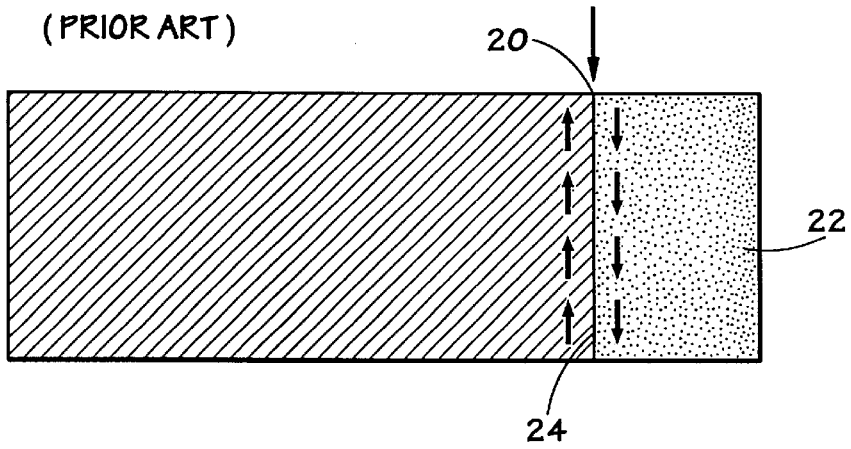
FIG. 3 (PRIOR ART)
FIG. 3 is a side cross-section of a typical cutting element illustrating the combination of stresses which act on a typical cutting element when applied to a downhole cutting tool.

Cutters which do not incorporate a ring describe the highest stresses at the periphery 20. (See FIG. 3) These stresses can oftentimes exceed the strength of the diamond 22 or the diamond to carbide interface 24 resulting in a loss of cutting material. Cutters which do not include a compressive ring describe the highest stress at the top of the step where sheer stresses from the face, sheer stress from the ring wall and compressive stresses are all at their highest. When the stresses are combined with cutting forces the strength of the diamond to carbide interface can be exceeded.

Figure 4:
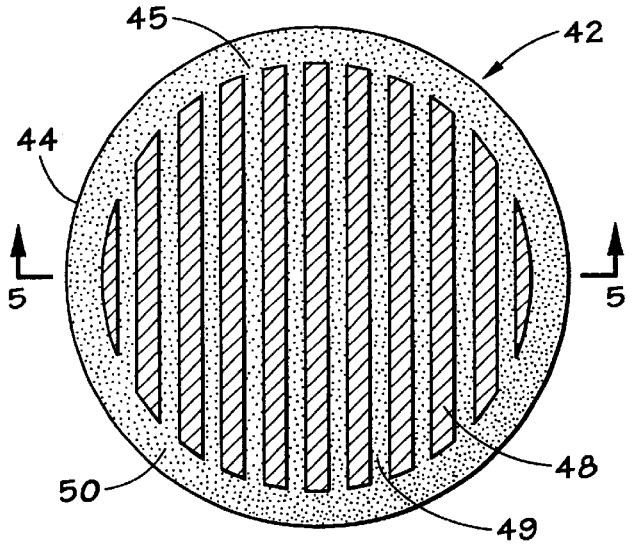
FIG. 4 (PRIOR ART)
FIG. 4 is a top view of a prior art "ring claw" cutting element.
Figure 5:
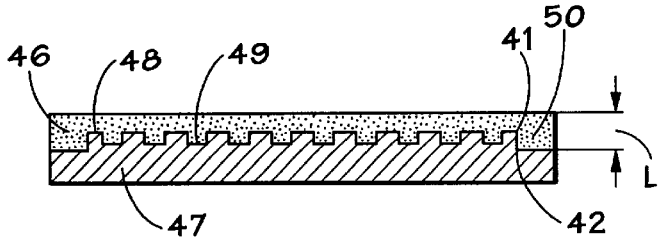
FIG. 5 (PRIOR ART)
FIG. 5 is a cross-section of the cutting element illustrated in FIG. 4.
Figure 7:
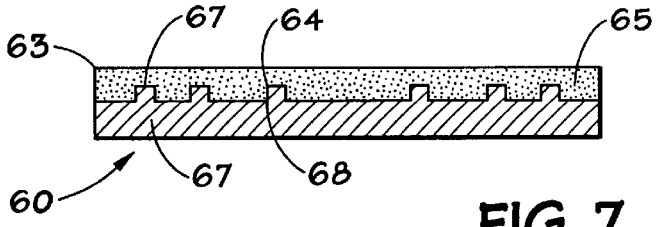
FIG. 7 (PRIOR ART)
FIG. 7 is a cross-section view of the cutting element of FIG. 6.
Figure 6:
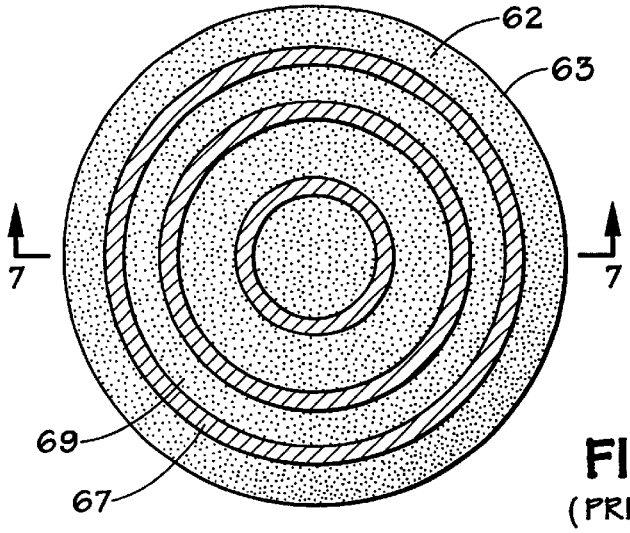
FIG. 6 (PRIOR ART)
FIG. 6 is a top view of a prior art "target" cutting element.

FIGS. 4–7 illustrate top, cross-sectional views of prior art cutters sold, in the instance of FIGS. 4–5, under the name "ring claw cutter" and in the instance of FIGS. 6–7, under the name "target cutter".

By reference to FIGS. 4–5, the "ring claw" cutter 42 comprises a disc shaped body 44 defining a peripheral cutting edge 45 bounding a top, cutting surface 46 comprised of a superabrasive material, commonly polycrystalline diamond. As illustrated, the polycrystalline cutting surface 46 is bonded to an underlying hard metal substrate 47, e.g. cemented tungsten carbide, defining a series of axial ridges 48 bounded by grooves 49 about which the superabrasive is formed and subsequently bonded. The "ring claw" cutter is characterized by a radial groove 50 formed at the outer periphery of body 44, which groove receives the polycrystalline diamond to form cutting edge 45, as shown.

The outer radial groove 50 is defined by an upper 41 and lower 42 inner boundary and the periphery 44, where an uninterrupted linear trace is formed therebetween of a given length "L." The presence of this trace gives rise to hoop stresses caused as a result of differential coefficients of expansion during cooling.

FIGS. 6–7 illustrate the prior art "target cutter" 60 which also includes a disc shaped body 62 defining a peripheral cutting edge 63 bounding a top cutting surface 65 again comprised of a polycrystalline diamond. In this prior embodiment, the carbide substrate 67 forms a series of concentric ridges 67 defining complementary grooves 69 in which the polycrystalline diamond is formed and subsequently bonded.

Similar to the ring claw embodiment of FIGS. 4–5, the grooves 69 formed in the substrate 67 include an upper 64 and lower 68 inner boundary which define an uninterrupted linear trace. As a result, the "target" cutter embodiment also suffers from problems of hoop stresses caused as a result of differential coefficients of expansion exhibited during cooling. These hoop stresses, in some cases, are severe enough as to result in delamination of the polycrystalline diamond layer.

Figure 8:
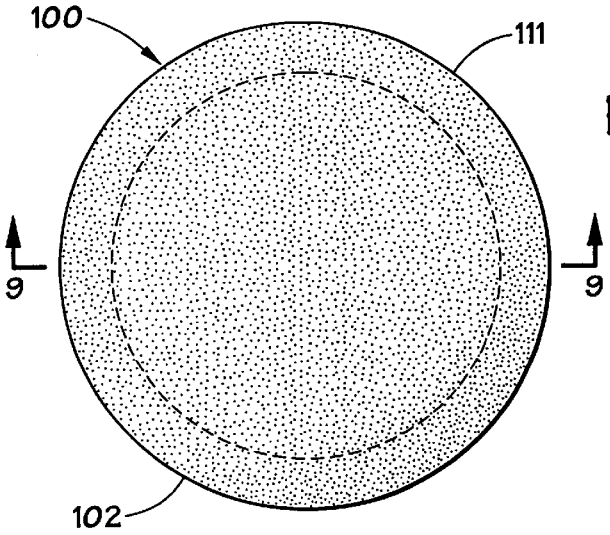
FIG. 8 is a top view of one embodiment of the cutting element of the present invention.
Figure 9:
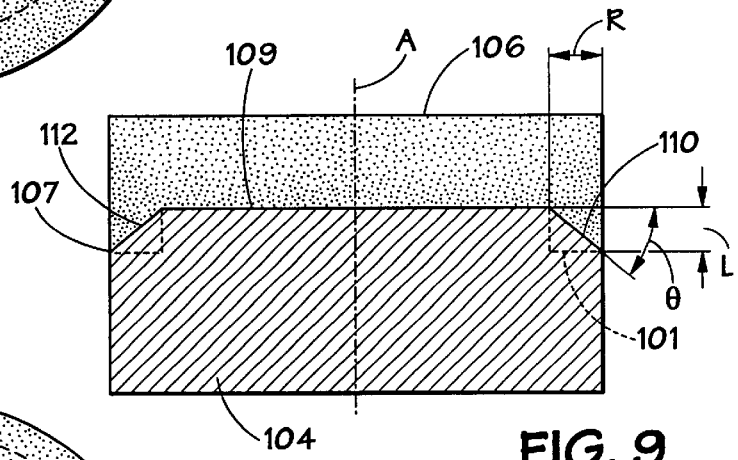
FIG. 9 is a side cross-section of the embodiment shown in FIG. 8.

A first embodiment of the cutting element 100 of the present invention may be seen by reference to FIGS. 8–9 in which is illustrated a disc-shaped body 102 comprised of a substrate 104 and an abrasive layer 106 which together define an interface 107. In a preferred embodiment, the substrate 104 is comprised of a tungsten carbide while the abrasive layer 106 is comprised of polycrystalline diamond. The substrate 104 defines a generally planar central region 109 bounded by an outer groove 110. In such a fashion, the thickness of the abrasive layer is thicker about the groove 110 than about the central region 109.

FIG. 9 illustrates in phantom the longitudinal and radial trace 101 which would be formed if a concentrical groove were incorporated as in the "target" and "ring claw" designs, where said traces would have a length of "L" and "R," respectively. It has been discovered that the foreshortening of "R" and "L" substantially decreases the hoop and other stresses associated with the cutting element. In this embodiment, therefore, both "L" and "R" are foreshortened by the incorporation of an outwardly beveled trace 112 which is included at an angle θ, by reference to a plane normal to axis "A." In such a fashion, the abrasive layer attains a maximum thickness at the periphery 111 of body 102. It is preferred that the angle of bevel θ be less than or equal to 45 degrees, though other angulations are contemplated within the spirit of the invention.

Figure 10:
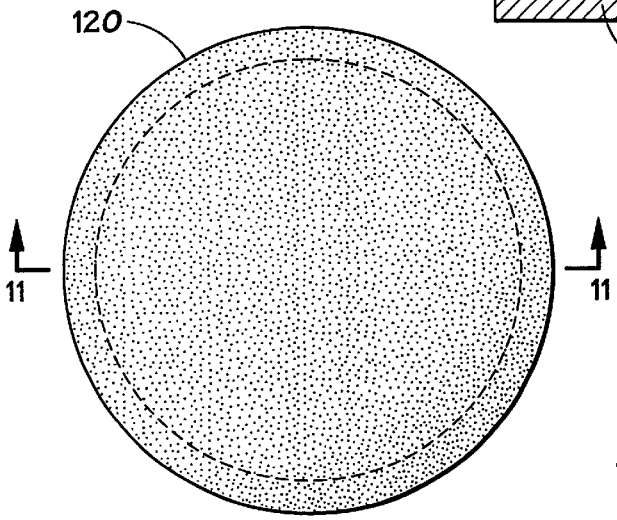
FIG. 10 is a top cross-section of one embodiment of a second embodiment of the invention.
Figure 11:
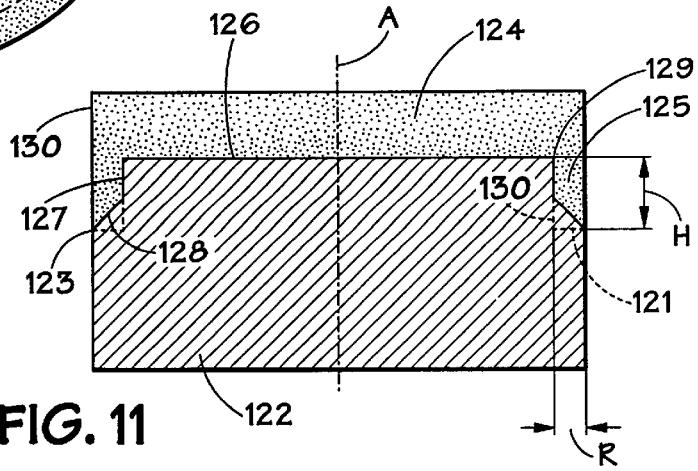
FIG. 11 is a side cross-section of the embodiment shown in FIG. 10.

A second embodiment of the invention is shown in FIGS. 10–11 which is illustrated a generally disc-shaped body 120 comprised of a substrate 122 and an abrasive layer 124 which together define an interface 123. Similar to the embodiment of FIGS. 8 and 9, this embodiment also includes a central planar region 126 bounded by an outer groove 128. The complete trace 121 of outer groove 128 is illustrated in phantom. Outer groove 128 defines an upper 129 and lower 130 inner boundary defining a height "H" and a radius "R." The lower, inner boundary is located at the lowest level in groove 128 and in some instances may be at the periphery. In this embodiment, the intersection between groove 128 and central planar region 126 defines a step 127 terminating in an outwardly sloping bevel 125. In such a fasion, the thickness "H" and width "R" of the trace of groove 128 are foreshortened. Additional desired thickness at the cutting edge 131 is therefore rendered possible while still addressing issues of compressive stresses.

Figure 12:
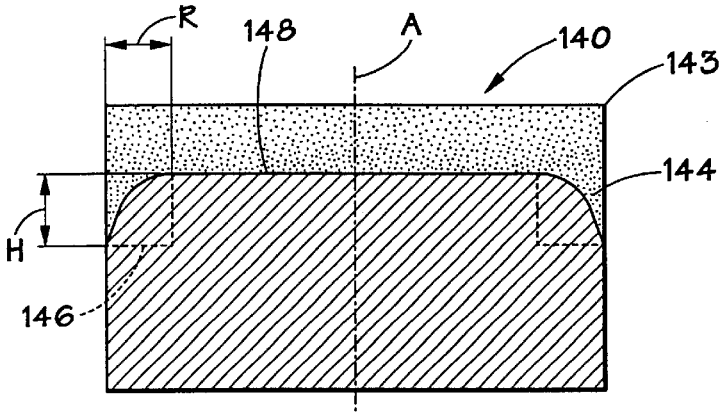
FIG. 12 is a side cross-section of a third embodiment of the invention.
Figure 13:
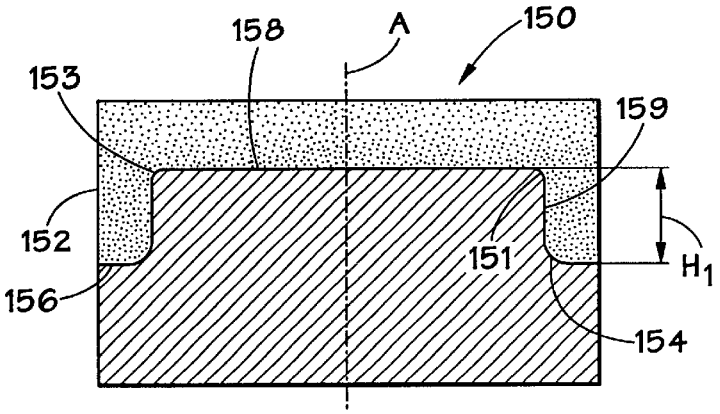
FIG. 13 is a side cross-section of a fourth embodiment of the invention.

Still other embodiments are illustrated at FIGS. 12–13. In FIG. 12, the cutting element 140 is comprised of a substrate 142 and an abrasive layer 144. In this embodiment, the substrate 142 includes an exterior groove 149 which defines an arcuate intersection boundary 147 with an internal planar region 148. The phantom trace 146 of a conventional groove is illustrated. The use of arcuate or curvilinear intersection 147 serves to foreshorten radius "R" and thickness "H," again resulting in stress reduction thereby results in a further reduction in compressive and combination stresses while still providing maximum thickness of the abrasive compound at the cutting edge 143.

The cutter 150 of FIG. 13 comprises a disc-shaped body 152 including a substrate 154 and an abrasive layer 155, where the substrate 154 defines an external groove or channel 156 and a generally planar central area 158. The phantom trace of the architecture of a concentrical groove is again illustrated. In this embodiment, the radius of the phantom trace is designated "R" and the maximum thickness of the abrasive layer in groove 156 is designated "H." This embodiment defines a pronounced "step" 159 which would ordinarily result in high compressive stress. The upper 151 and lower inner 154 boundary of step 159, however, has been modified to foreshorten both "H" and "R" by the inclusion of curvilinear points of intersection.

Figure 18:
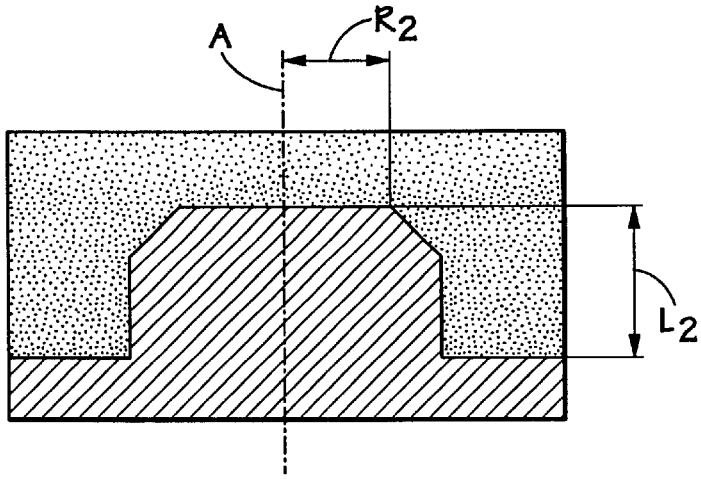
FIG. 18 is a side cross-section of a ninth embodiment of the invention.
Figure 19:
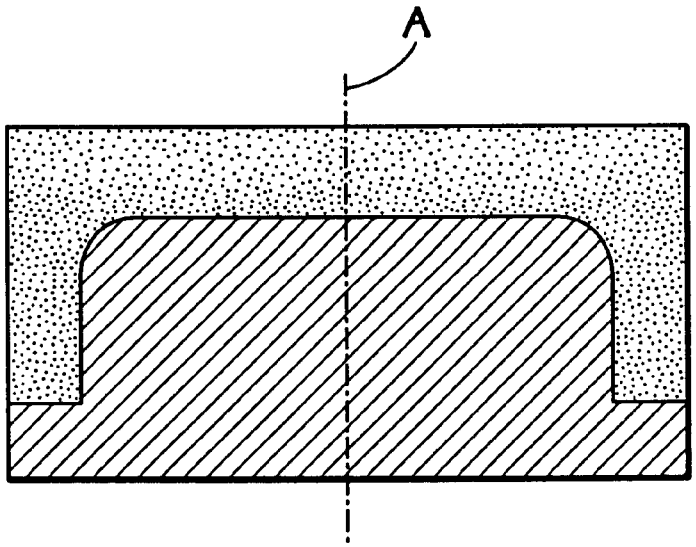
FIG. 19 is a side cross-section of a tenth embodiment of the invention.

Variations on this principle are seen in FIGS. 18 and 19. In both of these embodiments, the radius "R" and thickness "H" are foreshortened, albeit incorporating differing internal architecture. In both examples, compressive and total stresses are minimized.

Figure 14:
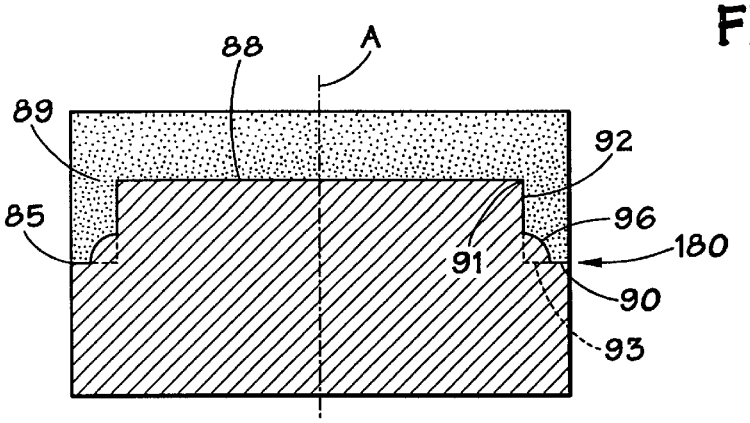
FIG. 14 is a side cross-section of a fifth embodiment of the invention.
Figure 15:
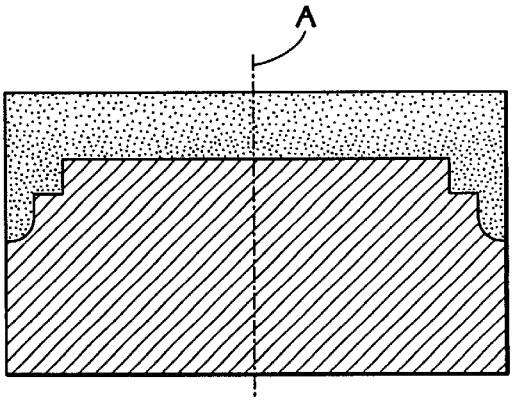
FIG. 15 is a side cross-section of a sixth embodiment of the invention.

Yet an additional embodiment is illustrated at FIG. 14. This embodiment also defines a disc-shaped body 180 which is comprised of a substrate 82 and abrasive layer 84, the combination defining an interface 85. The embodiment of FIG. 14 includes a central planar region 88 bounded by an outer groove 89. Outer groove 89 defines an upper 91 and lower 93 inner boundary, where the trace of the concentrical groove is illustrated in phantom. In this embodiment, the thickness "H" and radius "R" are foreshortened by the inclusion of a convex region, as illustrated.

Figure 16:
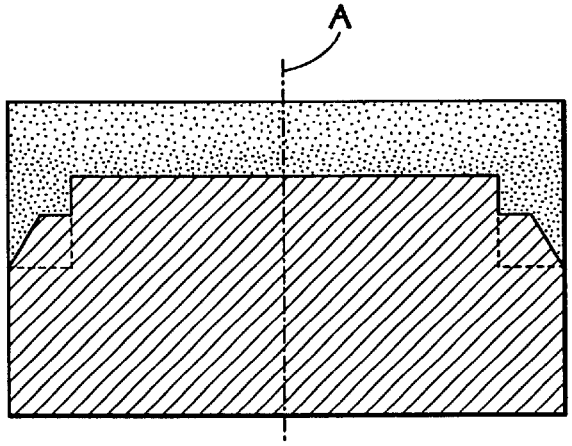
FIG. 16 is a side cross-section of a seventh embodiment of the invention.
Figure 17:
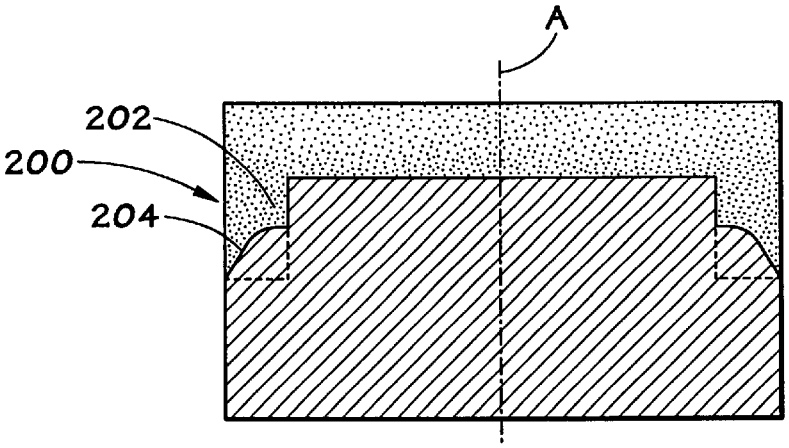
FIG. 17 is a side cross-section of an eighth embodiment of the invention.
Figure 20:
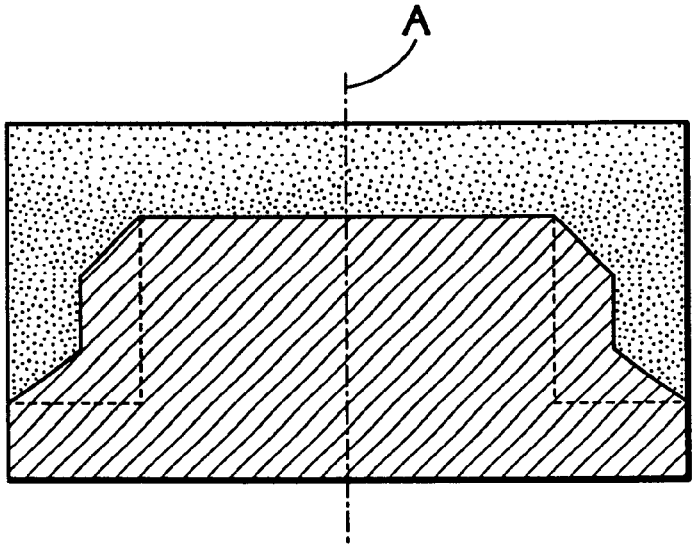
FIG. 20 is a side cross-section of an eleventh embodiment of the invention.

FIGS. 15, 16,17 and 20 illustrate yet additional embodiments of the invention. In each of these embodiments, a disc-shaped body includes an internal, planar portion which is bounded by a two-stage channel or groove of varying depths. As illustrated, this depth increases as one progresses radially outwardly from the axis "A." The interface between the two channels is variably characterized by arcuate or beveled surfaces such that the thickness of the abrasive compound variably increases toward the periphery. In each embodiment, however, the compressive stresses are reduced by architecture which results in a foreshortening of the thickness "H" and the radius "R" of the original channel trace. As illustrated in FIGS. 16 and 20, this foreshortening may be accomplished incrementally through a successive series of stepped, beveled or curvilinear surfaces.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A cutter including major front and back flat surfaces and a longitudinal axis where at least a portion of said front surface defines cutter face, said cutter comprising:

a disc shaped body including said back surface, an opposing interface surface, and a periphery, where said interface includes a first planar surface which is radially bordered by a groove which is defined by an upper and lower inner boundary and the periphery, where the uninterrupted trace from the upper to the lower inner boundary defines an inwardly extending arcuate surface along at least a portion of its length; and a superabrasive material bonded to said body at said interface to create a uniform cutting surface on said front face such that said the radial periphery defines a greater thickness of said superabrasive material than does the planar surface, when viewed along the longitudinal axis.

2. The cutter of claim 1 where said body is comprised of a cemented tungsten carbide.

3. The cutter of claim 1 where said superabrasive material comprises synthetic diamond.

4. The cutter of claim 1 where said trace from said upper to lower boundary also includes a beveled surface inclined at an angel θ as measured from the longitudinal axis.

5. The cutter of claim 4 where said angle θ is between 0 and 45° when measured from a line normal to the axis.

6. The cutter of claim 4 where said lower boundary is located at the periphery.

7. The cutter of claim 1 where the trace between the upper and lower boundary defines a curvilinear surface.

8. A cutter of claim 1 where the trace between the upper and lower boundary additionally defines ones or more stepped portions.

9. A cutter including major front and back flat surfaces and a longitudinal axis where at least a portion of said front surface defines a cutter face, said cutter comprising:

a disc shaped body including said back surface, an opposing interface surface, and a periphery, where said interface includes a first outer groove where said first outer groove is defined by a top and a lower boundary and said periphery;

a trace formed between said top and lower boundary where said trace is not parallel to said axis at all portions about its length and including at least one outwardly curved line segment; and a superabrasive material bonded to said body at said interface to create a uniform cutting surface on said front face such that said first outer groove defines a greater thickness of said superabrasive material, when viewed along the longitudinal axis.

10. The cutter of claim 9 where the surface of said groove also includes a downward bevel for at least a portion of its length such that the thickness of superabrasive material is greater at periphery than at any portion interior to said periphery.

11. The cutter of claim 10 where the beveled surface defines an angle θ which is between 0 and 45 degrees, when measured from a plane normal to the axis.

12. The cutter of claim 9 where said groove includes an interior shoulder which defines a concave shape.

13. The cutter of claim 9 where the lower boundary is located at said periphery.

14. The cutter of claim 9 where said body is comprised of a cemented tungsten carbide.

15. The cutter of claim 9 where said superabrasive material comprises synthetic, polycrystalline diamond.

16. The cutter of claim 9 where the trace from said lower boundary to said upper boundary includes a downwardly beveled segment for a portion of its length.

17. The cutter of claim 9 where said top and lower boundary defines at least one curvilinear segment.

18. An abrasive tool insert comprising:

a substrate having an end face; and a continuous abrasive layer having a center formed about a longitudinal axis, a periphery forming a cutting surface at a selected radial distance from said axis and a lower surface integrally formed on said end face of said substrate a selected distance from the cutting surface and defining an interface therebetween, said lower surface of said abrasive layer defining a first outer circular protrusion extending from said interface into the substrate where the said protrusion is defined by an upper and lower boundary and the periphery, where the trace formed between the lower boundary and the upper boundary is interrupted by at least one curvilinear segment and further includes a downwardly beveled region.

19. The abrasive tool insert of claim 18 where said substrate is comprised of cemented tungsten carbide.

20. The abrasive tool insert of claim 19 where said abrasive layer comprises polycrystalline diamond.

21. The abrasive tool insert of claim 18 where said lower boundary is situated at the periphery.

22. The abrasive tool insert of claim 18 where said downwardly beveled region defines an angle θ which is between 0 and 45 degrees, as measured from a plane taken normal to the axis.

23. A cutter including major front and back surfaces and a longitudinal axis where at least a portion of said front surface defines a cutter face, said cutter comprising:

a disc shaped body including said back surface, an opposing interface surface, and a periphery, where said interface includes a first planar surface which is radially bordered by a groove which is defined by an upper and lower inner boundary and the periphery, where the line segment between the upper and lower boundary defines an outwardly extending, arcuate line trace along at least a portion of its length; and a superabrasive material bonded to said body at said interface to create a uniform cutting surface on said face such that the radial periphery defines a greater thickness of said superabrasive material than does the planar surface, when viewed along the longitudinal axis.

24. The cutter of claim 23 where the lower inner boundary is positioned at the periphery.

* * * * *